United States Patent [19]

Heierli

[11] Patent Number: 4,458,457

[45] Date of Patent: Jul. 10, 1984

[54] OVERFILLED ARCH OUT OF PREFAB REINFORCED CONCRETE SHELLS

[76] Inventor: Werner Heierli, Eichhalde 19, 8053 Zurich, Switzerland

[21] Appl. No.: 327,071

[22] Filed: Dec. 3, 1981

[30] Foreign Application Priority Data

Dec. 8, 1980 [CH] Switzerland ..... 9024/80

[51] Int. Cl.[3] ..... E04B 1/32; E01C 1/04

[52] U.S. Cl. ..... 52/87; 52/89; 52/245; 52/259; 404/1

[58] Field of Search ..... 52/86–89, 52/609, 245; 404/1

[56] References Cited

U.S. PATENT DOCUMENTS

| | | | |
|---|---|---|---|
| 597,590 | 1/1898 | Pratt | 52/87 X |
| 786,059 | 3/1905 | Simpson | 52/89 X |
| 820,342 | 5/1906 | Besser | 52/88 X |
| 1,004,051 | 9/1911 | Luten | 52/88 |
| 1,168,583 | 1/1916 | Volz | 52/245 X |
| 2,129,932 | 9/1938 | Huddleston | 52/88 |

FOREIGN PATENT DOCUMENTS

| | | | |
|---|---|---|---|
| 35180 | 4/1886 | Fed. Rep. of Germany | 52/245 |
| 360881 | 5/1906 | France | 52/89 |
| 603504 | 4/1960 | Italy | 52/91 |
| 129296 | 8/1950 | Sweden | 52/609 |

*Primary Examiner*—Alfred C. Perham

*Attorney, Agent, or Firm*—Terry M. Gernstein

[57] ABSTRACT

An arch is formed of prefabricated reinforced concrete shells connected at the arch apex by an on-site cast concrete joint is built as a skewed underpass structure. In order to avoid complicated edge elements or a costly lengthening of the underpass, the individual reinforced concrete shells are formed to have their horizontal projection (in the horizontal projection of an assembled underpass) define a parallelogram which includes at least one acute angle which correspond to the acute angle formed by the intersection of the axis of the overpass traffic route with the axis of the underpass traffic route. Thus, edge elements are not necessary. An apex joint is formed of on-site cast concrete. Reinforcement rods extend into the apex joint and are arranged in an asymmetrical manner so that all elements can be designed and reinforced in the same manner with the reinforcement rods in the joint meeting directly.

5 Claims, 3 Drawing Figures

OVERFILLED ARCH OUT OF PREFAB REINFORCED CONCRETE SHELLS

The invention deals with overfilled arches made out of prefabricated reinforced concrete shells (reinforced concrete elements).

A number of embodiments of overfilled arches made out of prefabricated reinforced concrete shells is known. In the majority of the cases, the arches are built out of two curved reinforced concrete shells, which are connected at the arch apex by means of an on-site cast concrete joint (apex joint). The below description pertains to such type of construction. In the case of all known embodiments, the reinforced concrete shells are rectangles in the horizontal projection of an assembled arch.

Frequently, overfilled arches out of prefabricated reinforced concrete elements serve for the crossing of a (higher) traffic route over a (lower) traffic route or river. The horizontal projections of the axes of both traffic routes often do not intersect at right angles. In the case of arches with reinforced concrete elements, which are rectangular in the horizontal projection, the necessity does thus arise either to insert reinforced concrete elements at the arch end, that are trapezoidal in the horizontal projection or designed differently than the other elements in some other way, or to substantially lengthen the arch on both sides. In both cases, thus are created considerably additional expenditures: in the first case, due to the fact that special elements with especially strong reinforcement will have to be provided, and in the second case, because of the considerably greater arch surface which, due to reasons of space or because of the visual range of this larger arch, is frequently not realizable.

The invention has the task to eliminate these disadvantages in that, although the arch is designed slanting in the horizontal projection, i.e., that there is not required an additional arch surface, in spite of this, only a single type of reinforced concrete elements needs to be used for the arch.

In accordance with the invention, the set goal is achieved by designing each individual reinforced concrete element slanting, and namely with the same obliquity as the arch and, further, in that the reinforcement of the elements is arranged in an asymmetrical manner.

Figure 1:
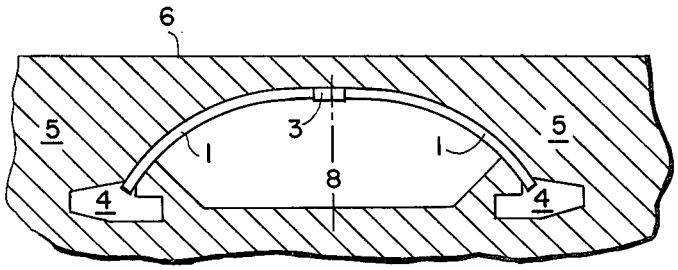
Figure 2:
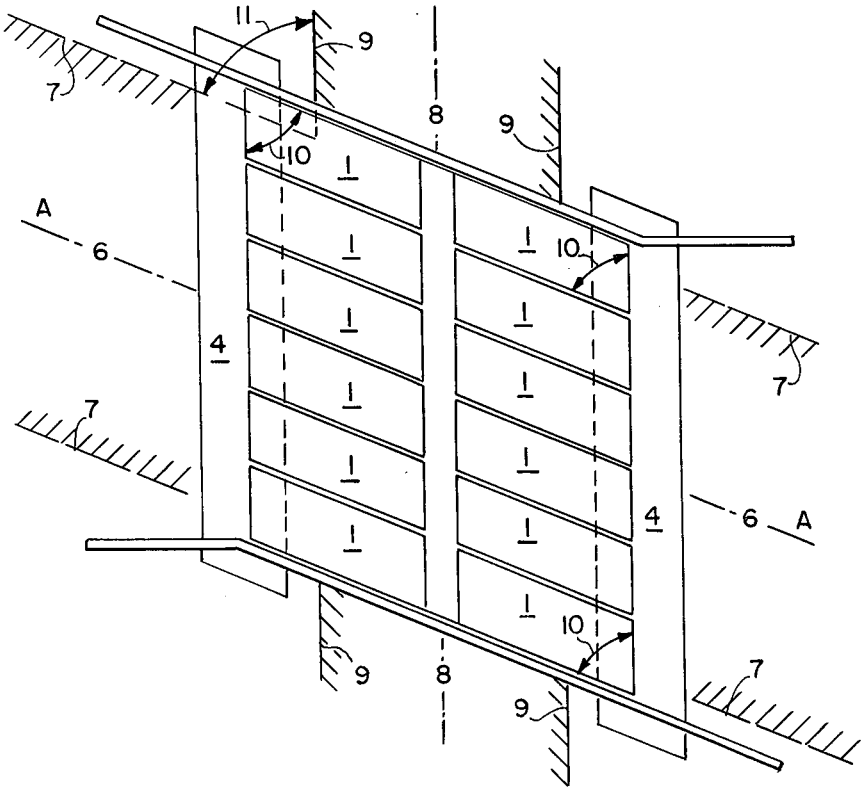
Figure 3:
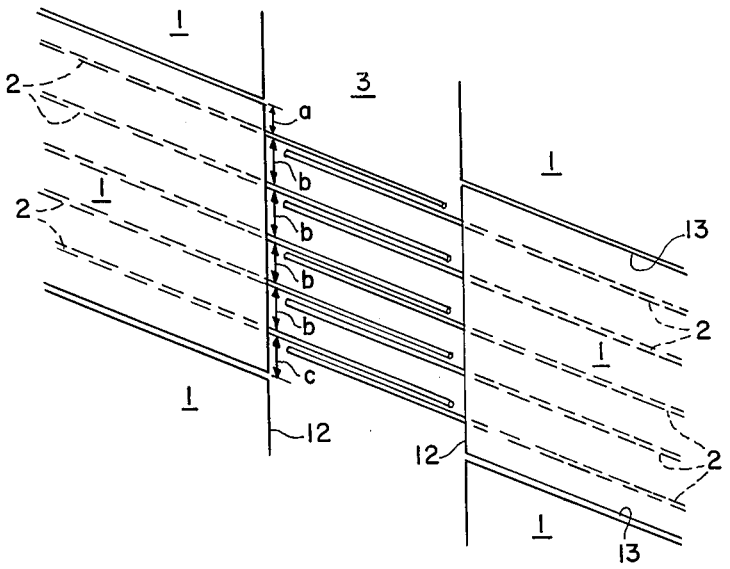

On hand of the attached drawings an embodiment of the invention is described in more details hereafter. Shown are in:

FIG. 1 a vertical cross section A—A through the arch, parallel to the axis of the overpassing traffic route;

FIG. 2 a horizontal projection of the arch, wherein it is not overfilled in this representation;

FIG. 3 a horizontal projection of the arch in the apex portion, enlarged compared with FIG. 2.

In FIG. 1 can be seen the elements 1, which are supported on the foundations 4 and are connected in an apex joint 3 out of on-site cast concrete. On the overfill 5 rests the overpass traffic route 6, which runs over the underpass traffic route 8. The axes (6 and 8) of the traffic routes 6 and 8 as well as the edges 7 resp. 9 are shown in FIG. 2.

In FIG. 2 are represented the superposed reinforced concrete elements 1. In this horizontal projection representation they are parallelograms, wherein the acute angle 10 of the parallelogram does fully or almost coincide with the angle 11 between the traffic route axes 6 and 8.

FIG. 3 shows the apex joint 3 with the reinforcement rods 2. These latter run parallel to the lateral edges of the elements 13 and project from the front sides 12. The reinforcement rods 2 are therein arranged at equal axis distances b, from each other, but the distances a and c at both edges do differ from each other by a few reinforcement rod diameters. The distances a and c are arranged in such a manner, that the horizontal projections of the two shown elements can be made to coincide by a 180° rotation. Both elements and thus all elements of an arch are therefore designed in the same manner, which is of great advantage (standardization of manufacture, storage, intermediate storage, assembly). The distance from rod axis to rod axis is twice, or more, the diameter of the rod.

I claim:

1. An overfilled transportable arch for suppporting an overcrossing traffic route which passes over a lower route comprising a plurality of reinforced concrete shells, with a deviating angle between the traffic route overpassing the arch and the lower route passing under the arch, the reinforced concrete shells each being of uniform thickness throughout and being prefabricated, the shells each being a parallelogram which includes a pair of parallel sides and a pair of parallel ends with at least one angle, being an acute angle, as seen in a horizontal projection between a side and an end thereof, each of the shells further having the sides thereof extending transverse of the overcrossing traffic route and parallel to the lower traffic route.

2. An overfilled transportable arch for supporting an overcrossing traffic route which passes over a lower route comprising a plurality of reinforced concrete shells, each connected at the arch apex thereof to another shell by an on-site cast concrete joint, with a deviating angle between the traffic route overpassing the arch and the lower route passing under the arch, the reinforced concrete shells each being of uniform thickness throughout and being prefabricated, the shells each being a parallelogram which includes a pair of parallel sides and a pair of parallel ends with at least one angle, being an acute angle, as seen in a horizontal projection between a side of and end thereof, each of the shells further having the sides thereof extending transverse of the overcrossing traffic route and paralel to the lower traffic route.

3. The overfilled arch in accordance with claim 2, further including a plurality of reinforcement rods, said rods each projecting from front sides of said shells in each apex joint portion and extending parallel to the ends of said shells in the arch direction, said reinforcement rods being arranged at unequal distances from the ends of each shell.

4. The overfilled arch in accordance with claims 2 or 3 wherein all reinforced concrete shells of one arch are identical to each other.

5. The overfilled arch in accordance with claim 3, wherein said unequal spacing varies in a range of a plurality of rod diameters.

* * * * *